US006820685B1

(12) United States Patent
Carter et al.

(10) Patent No.: US 6,820,685 B1
(45) Date of Patent: Nov. 23, 2004

(54) DENSIFIED HEAT TRANSFER TUBE BUNDLE

(75) Inventors: Thomas P. Carter, Olney, MD (US); David A. Aaron, Reisterstown, MD (US); Frank T. Morrison, Crownsville, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 0 days.

(21) Appl. No.: 10/786,142

(22) Filed: Feb. 26, 2004

(51) Int. Cl.[7] ..... F28D 7/08

(52) U.S. Cl. ..... 165/150; 165/163; 165/177

(58) Field of Search ..... 165/150, 152, 165/163, 171, 172, 175, 177–179, 910, 903, 113, DIG. 435–DIG. 441; 261/152, 153; 138/155

(56) References Cited

U.S. PATENT DOCUMENTS

| | | | | |
|---|---|---|---|---|
| 2,752,124 A | | 6/1956 | Nofziger | |
| 2,890,864 A | | 6/1959 | Stutz | |
| 2,919,559 A | | 1/1960 | Koch | |
| 3,132,190 A | | 5/1964 | Engalitcheff, Jr. | |
| 3,148,516 A | | 9/1964 | Kals | |
| 3,265,372 A | | 8/1966 | Bradley | |
| 3,346,043 A | * | 10/1967 | Thurnauer | 165/162 |
| 3,357,484 A | * | 12/1967 | Maher | 165/76 |
| 3,800,553 A | | 4/1974 | Engalitcheff, Jr. | |
| 4,196,157 A | * | 4/1980 | Schinner | 261/155 |
| 4,683,101 A | * | 7/1987 | Cates | 261/146 |
| 4,755,331 A | * | 7/1988 | Merrill et al. | 261/153 |
| 5,425,414 A | | 6/1995 | Bradley, Jr. et al. | |
| 5,435,382 A | | 7/1995 | Carter | |
| 5,535,820 A | * | 7/1996 | Beagle et al. | 165/150 |
| 5,799,725 A | | 9/1998 | Bradley, Jr. et al. | |
| 6,216,486 B1 | * | 4/2001 | Aaron et al. | 62/434 |

FOREIGN PATENT DOCUMENTS

DE 34 13 999 A1 11/1985

* cited by examiner

*Primary Examiner*—Tho Duong
(74) *Attorney, Agent, or Firm*—Oliff & Berridge, PLC

(57) ABSTRACT

A heat exchanger coil assembly is made up of arrays of substantially equally spaced apart serpentine circuits located in the coil assembly region of the conduit, with adjacent circuits being arranged in a parallel offset fashion in which adjacent return bends are overlapping. The tubes have an effective diameter of D. Depression areas are provided at the points of overlap to locally reduce the diameter at the overlap. This provides a circuit-to-circuit with a density D/S>1.0, preferably greater than 1.02, where S is the spacing between adjacent circuits and D is the effective diameter of the tubes.

23 Claims, 8 Drawing Sheets

DENSIFIED HEAT TRANSFER TUBE BUNDLE

BACKGROUND OF THE INVENTION

1. Field of Invention

This invention relates to a heat exchange tube bundle having a uniformly densified structure. More particularly, this invention relates to such a bundle and method of manufacture in which dimples are provided at least at overlap regions of return bends so that resultant overlapping tubes can be packed with an increased density in which the circuit-to-circuit spacing between adjacent tubes is less than the projected cross-sectional area of the individual tubes.

2. Description of Related Art

Various heat transfer tube bundle systems are known. Condensers and closed circuit cooling towers typically include a bundle of numerous lengths of tubing in an array. The tubing may be in serpentine form or as a series of discrete tubes that run into a header section. The tubing contains a condensing vapor or a medium to be cooled, such as water. In the finished product, air and/or water is forced to flow over the external surfaces of the tubing.

Counterflow evaporative heat exchangers are shown and described in, for example, U.S. Pat. Nos. 3,132,190 and 3,265,372. Those heat exchangers comprise an upwardly extending conduit containing an array of tubes which form a coil assembly. A spray section is provided in the conduit above the coil assembly to spray water down over the tubes; and a fan is arranged to blow air into the conduit near the bottom thereof and up between the tubes in counterflow relationship to the downwardly flowing sprayed water. Heat from the fluid passing through the coil assembly tubes is transferred through the tube walls to the water sprayed down over the tubes; and the upwardly flowing air causes partial evaporation of some of the water and transfer of heat and mass from the water to the air. The thus heated and humidified air then flows upwardly and out from the system. The remaining water collects at the bottom of the conduit and is pumped back up and out through spray nozzles in recirculatory fashion.

There are other evaporative type heat exchangers in which the liquid and gas flow in the same direction over the coil assembly. Examples of these other devices, which are generally referred to as co-current flow heat exchangers, are shown in U.S. Pat. Nos. 2,752,124, 2,890,864, 2,919,559, 3,148,516 and 3,800,553.

The above are types of coil only heat exchangers. There are other types, such as coil/fill types that are provided with both an indirect evaporative heat exchanger section and a direct evaporative heat exchanger system. U.S. Pat. No. 5,435,382 is an example of such a heat exchanger.

Various different methodologies of heat transfer tube bundle designs have been tried in the above conventional systems. In earlier designs, coil assemblies of round tubing were packed into tight arrays to increase surface area. The number of circuits that could be packed into a serpentine tube bundle was limited by the diameter of the tubing. This was because the return bends overlapped each other and would thus touch when spaced close together.

Subsequent designs, such as U.S. Pat. No. 4,196,157, were directed to a sparsified heat transfer tube bundle in which the spacing was increased to allow more airflow between the tubes, higher internal film coefficient, and better wetting of the tubes in attempts to increase total heat transfer rates. Other designs such as those in U.S. Pat. Nos. 5,425,414 and 5,799,725 kept packing density high and used circular return bend systems, but provided elliptical tube sections in the straight sections in an attempt to increase airflow. Packing in such examples was again limited by the diameter of the circular return bend. German Patent Publication No. DE3,413,999C2 is directed to oval tubes and describes problems forming oval tubes into U-bends.

Some prior art designs attempted to increase capacity by "pulling down" the bundled tubing slightly, such as by compressed clamping of the entire bundle during assembly. While this has been found to allow for slightly tighter spacing for a given heat exchanger size (typically 1/64" or so), such compression does not act uniformly on the tube bundle, but instead focuses compression forces on the endmost tubes. If the pull down is excessive, this results in a tube bundle with inconsistent flow properties, since the endmost tubes (uppermost and lowermost) may be disproportionately deformed so as to cause a flow or pressure problem at these circuits. For these reasons, "pull down" has typically been limited to no more than 2% of the return bend width. Thus, packing has been limited to a density that was typically less than 1.0, and possibly slightly greater than 1.0 (up to 1.02) through "pull down". However, such increased density was not controllably uniform or precise.

SUMMARY OF THE INVENTION

There is a need for an improved heat exchanger tube bundle design and method of manufacture that can increase heat transfer surface area for a given heat exchanger size.

There also is a need for a heat exchanger tube bundle design that can increase bundle density. There is a particular need for a heat exchanger tube bundle design that increases bundle density uniformly, so that all circuits can maintain consistent functionality.

The invention allows for increased heat transfer surface area to be packed into the same space/size constraints of prior designs or, conversely, allows the same heat transfer surface area of the prior art to be provided in an enclosure that occupies less space. Either technique increases the heat transfer surface area/cost ratio. The invention also reduces pressure drop in the heat exchanger by providing more circuits over prior art designs.

The present invention achieves these objects in a novel manner. According to one aspect of the present invention, the number of tubes in the coil assembly of a heat exchanger is increased from that which would previously have been considered possible to provide maximum heat transfer surface area for a given heat exchanger size. The coil assembly is made up of arrays of substantially equally spaced apart tube segments located at different levels in the coil assembly. According to this aspect of the invention, the coil assembly is arranged to have individual circuits of an effective diameter D and a circuit-to-circuit spacing S that is less than D. When a non-circular cross section is used, the outside perimeter of the tube divided by pi is considered as the effective diameter D.

The invention may be practiced in most any type of heat exchanger where overlapping circuits of tubing are provided. Tubing may be continuous or discontinuous, such as such as straight tubing with separately fabricated return bends. Non-limiting examples include evaporatively cooled heat exchangers, air cooled heat exchangers, and shell and tube heat exchangers. The inventive coil assembly is particularly advantageous for use with serpentine tubing. Coil-only type heat exchangers may show improved performance properties since the inventive coil assembly allows more heat transfer surface area to be provided in the same space constraint. However, in certain applications there may be an adverse decreased airflow, since the flow path between the circuits is marginally decreased, which offsets some of the thermal advantage of more heat transfer surface area. The invention, however, is more preferably useful in coil/fill type heat exchangers because the increase in tube bundle density does not decrease overall unit air flow to the same degree that it may in a traditional coil only tube bundle.

The use of dimpling to locally reduce the outer dimensions of the tubing in the area of overlap is advantageous, since it has only a minimal increase in internal fluid pressure drop compared to compressing of the entire return bend. Moreover, dimples are easier to form than compression of an entire return bend, while having minimal, if any, effect on the structural characteristics of the tubing. Moreover, the stacking of adjacent tubing that nests in the dimple serves to reinforce the dimple area, reducing any such effect.

In embodiments of the invention, indentations or "dimples" of predetermined dimensions, preferably having a depth of 2.5% to 50% of the tubing diameter, are locally provided at one or more predetermined points on at least one of two overlapping adjacent tube sections. When such tube sections are stacked together, adjacent return bends nest in these dimples, allowing the circuits to be more tightly packed than conventional non-dimpled return bends. An exemplary embodiment has dimples with a depth of between 1/16" to 3/16". However, dimpling is not limited to this. Actual dimpling size may be selected based on several criteria, including the desired degree of compression/density, structural considerations, and the maximum reduction in tubular cross-sectional area as allowed by fluid, gas or two phase velocity and/or pressure drop.

In an exemplary embodiment, dimpling is provided on both sides of every return bend. In an alternative embodiment, dimpling is provided on both sides of every other return bend, leaving adjacent return bends undimpled but producing the same overall effect. In yet another exemplary embodiment, each return bend is dimpled in two places on one side of the tubing so that regardless of the order of stacking of circuits, the tube bundles will always nest uniformly. In yet a further exemplary embodiment, dimpling can be performed on both sides of all tubes, but with a reduced or less pronounced dimple size. This will have the same net result as larger dimples being provided on only one side. In yet another embodiment, the same effect can be achieved by use of a non-circular reduced cross-section in the process direction. An example of this would be an elliptical cross-section.

In exemplary embodiments of the invention, the dimples can be formed en mass by a die or jig that forms the dimples substantially simultaneously to all required areas on a circuit. Alternatively, individual dimples can be formed during the formation of the serpentine return bends. The particular method of production may be selected based on the particular method of tube manufacture used.

BRIEF DESCRIPTION OF THE DRAWINGS

The invention will be described with reference to the following drawings, wherein.

DETAILED DESCRIPTION OF PREFERRED EMBODIMENTS

The inventive coil assembly arrangement is applicable to many different types of heat exchangers, including, but not limited to indirect evaporative heat exchangers, air-cooled heat exchangers, thermal storage units, and shell and tube heat exchangers. In an indirect evaporative heat exchanger, three fluid streams are involved: an air stream, an evaporative liquid stream, and an enclosed fluid stream, which can be a liquid or gas. The enclosed fluid stream first exchanges heat with the evaporative liquid through indirect heat transfer, since it does not directly contact the evaporative liquid, and then the evaporative liquid and the air stream evaporatively exchange heat when they directly contact each other. In a direct evaporative heat exchanger, only an air stream and an evaporative liquid stream are involved and the two streams evaporatively exchange heat when they come into direct contact with each other. The evaporative liquid is typically water.

Closed loop evaporative heat exchangers can be broadly grouped into three general categories: 1) stand alone indirect evaporative heat exchangers; 2) combination direct and indirect evaporative heat exchangers, and 3) coil sheds.

Stand alone indirect evaporative heat exchangers represent the first group Products with the air and evaporative liquid streams in counterflow, crossflow or concurrent flow are commercially available, although the counterflow design predominates.

The second group involves products which combine both indirect and direct evaporative heat exchange sections. The last group includes coil sheds, which consist of a direct evaporative and non-ventilated indirect heat exchanger.

Figure 1:
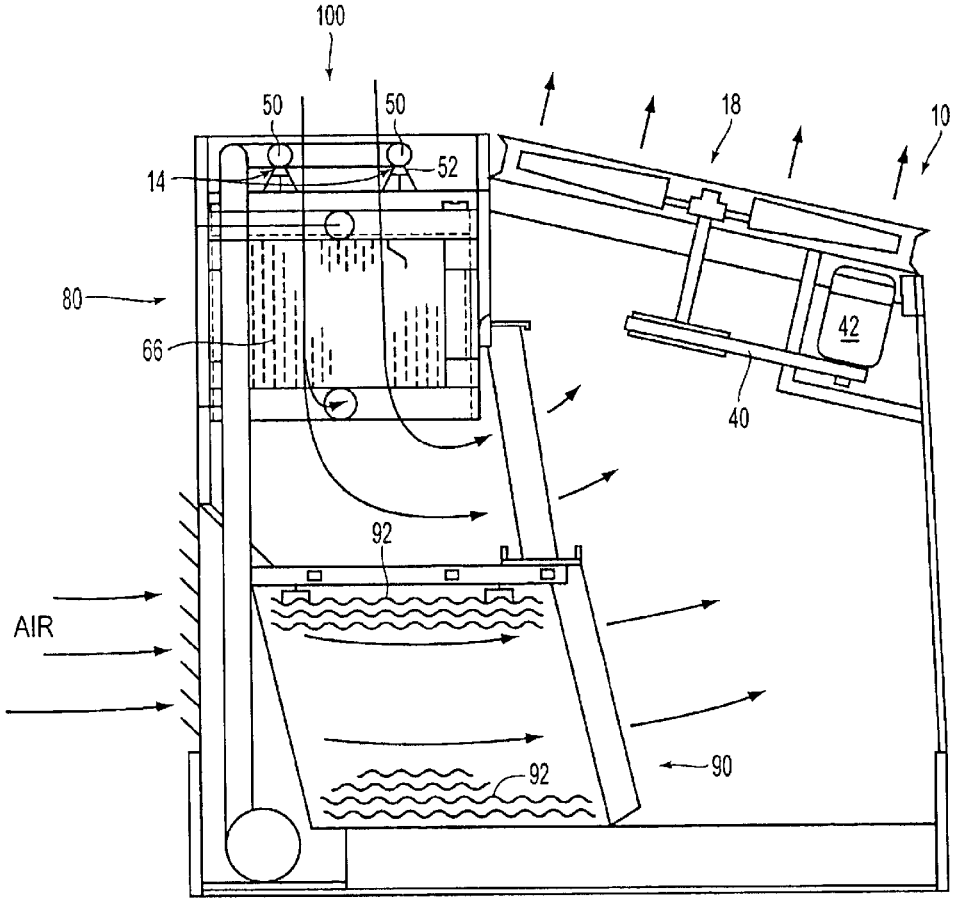
FIG. 1 is a side elevational view in partial section of an exemplary heat exchanger of a coil/fill type including an indirect evaporative heat exchanger section and a direct evaporative heat exchange section incorporating a densified heat tube bundle according to the present invention.

A first exemplary heat exchanger to which the inventive densified tube coil assembly can be provided is shown in FIG. 1. The heat exchanger apparatus 10 is of the coil/fill type and may serve as a closed-circuit cooling tower. Generally, apparatus 10 includes an enclosure structure which contains a multi-circuit indirect evaporative fluid cooling section 80, a direct evaporative heat exchange section 90, a lowermost evaporative liquid collection sump that delivers liquid to an uppermost water spray assembly 14 through a pipe distribution system 50 with nozzles 52, and a fan assembly 18. The water assembly 14 sprays an evaporative liquid downwardly through apparatus 10. The fan 18, driven by motor 42 through belt 40, moves a stream of air through each of the heat exchange sections 80 and 90, although natural draft is also a viable means for moving the air. Fan 18 can either be an induced or forced draft centrifugal fan or a common propeller type of fan.

Apparatus 10 has many applications in the heat exchange field. For example, apparatus 10 may be used to cool a single phase, sensible fluid such as water, which is flowing within an externally-supplied closed circuit system, or it may be used to desuperheat and condense a multi-phase, sensible and latent fluid such as a refrigerant gas, also supplied from an external closed-circuit system. Finally, the operable field of use for apparatus 10 also includes duty as a wet air cooler, where the air discharged is piped offsite to be used as a fresh, cooled air supply for an operation such as mining.

As will become evident, the tower structures containing the above-mentioned components can also be arranged and formed in a number of different ways; apparatus 10 is not limited to strictly one shape or arrangement.

The indirect heat exchange section 80, which is comprised of a single coil assembly having an array of tubes 66, is superposed above the direct evaporative heat exchange section 90. The indirect heat exchange section 80 receives a flowing hot fluid to be cooled from an offsite process and it is cooled in this section by a combination of indirect sensible heat exchange and a direct evaporative heat exchange. The evaporative liquid, which is usually cooling water, is sprayed downwardly by assembly 14 onto the indirect section, thereby exchanging indirect sensible heat with the fluid to be cooled, while a stream of ambient air entering primary air inlet 100, evaporatively cools the evaporative liquid as the two mediums move downwardly through the coil assembly. In this particular embodiment, the entering air stream is shown entering and flowing in a direction which is parallel or concurrent with the direction of cooling water, although the air flow stream is not limited to any particular flow pattern, as will become evident later on where a crosscurrent air flow pattern will be explained. Once the air and water cooling mediums reach the bottom side of indirect section 80, they split, with the air stream being pulled by fan 18, while the water gravitationally descends into direct heat exchange section 90. The air is then discharged from apparatus 10 by the fan, while the water is cooled in the direct heat exchange section as will be explained shortly. Air stream entering inlet 100 supplies air that will only be used for cooling purposes in the indirect heat exchange section, regardless of the actual air flow pattern through said section.

The direct evaporative heat exchange section 90 functions to cool the water that is heated and descending from the indirect heat exchange section 80. Direct evaporative heat exchange section 90 is comprised of an array of tightly-spaced, parallel, plastic sheets which form a fill bundle 92, although fill 92 could be formed by conventional splash-type fill. The hot water received by fill bundle 92 from indirect section 80 is distributed across each fill sheet so that a source of outside ambient air which enters a secondary air inlet evaporatively cools the hot water descending the sheets. Here, the ambient air stream is shown entering direct section 90 in a crosscurrent fashion to the descending hot water draining through the fill bundle 92, although other air flow schemes can be used.

Figure 2:
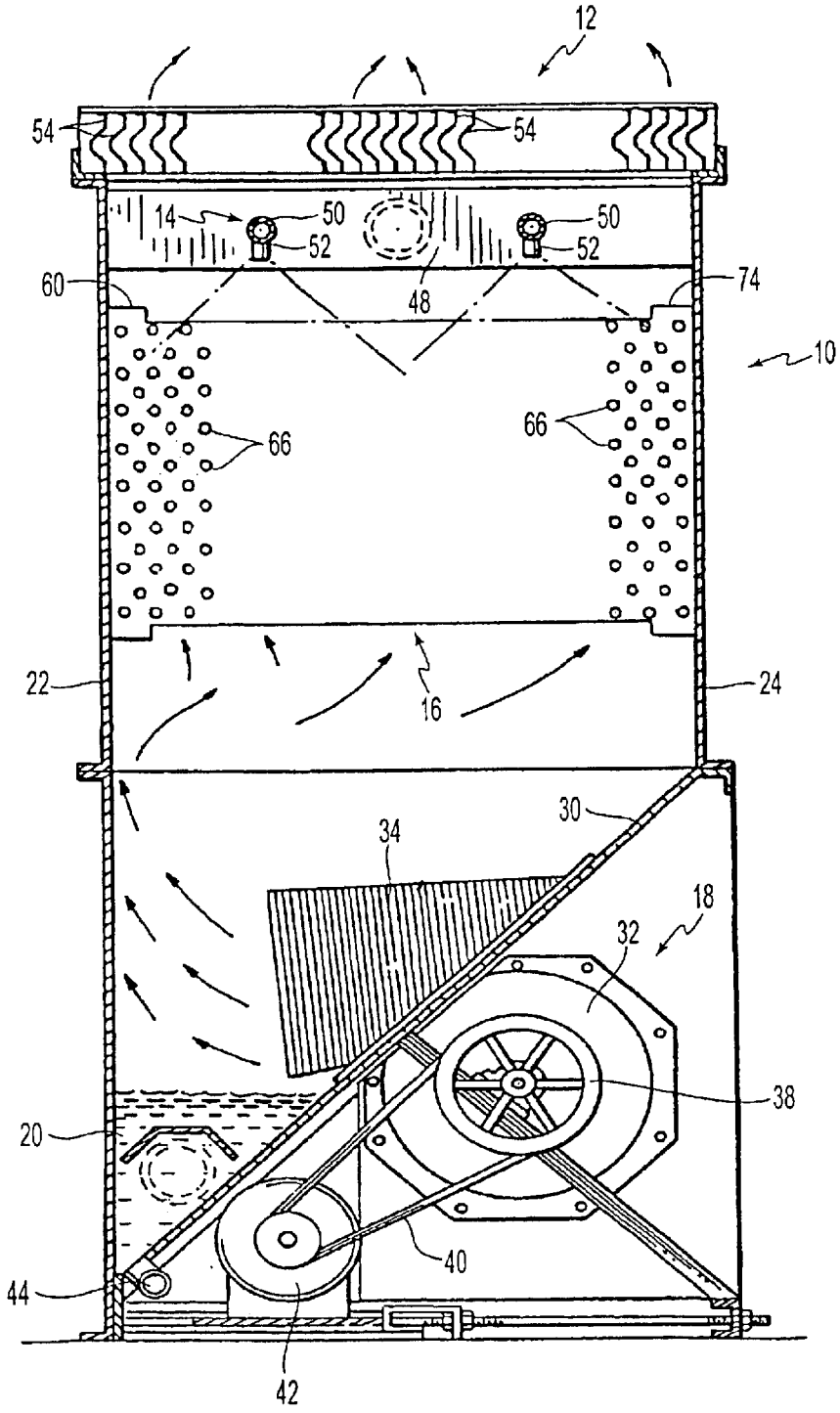
FIG. 2 is a side view of another exemplary embodiment of the invention in which the densified coil assembly is provided in a coil only type heat exchanger.

A second exemplary heat exchanger to which the inventive tube coil assembly can be provided is shown in FIG. 2 and includes a generally vertical conduit 10 of sheet metal construction and having, at different levels in the interior thereof, an upper mist eliminator assembly 12, a water spray assembly 14, a coil assembly 16, a fan assembly 18 and a lower water trough 20.

Figure 3:
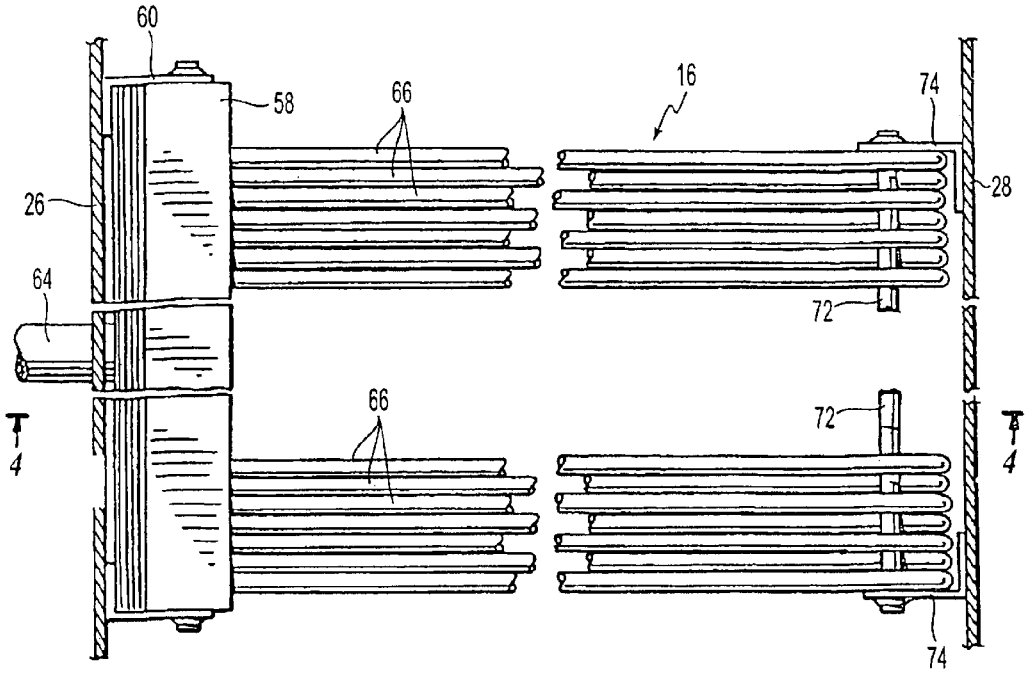
FIG. 3 is a plan view in partial section of the heat tube bundle in the exemplary heat exchangers of FIGS. 1 and 2.

The vertical conduit 10 may be of rectangular, generally uniform, cross-section and comprises vertical front and rear walls 24 and 22 (FIG. 2) and vertical side walls 26 and 28 (FIG. 3). A diagonal wall 30 extends downwardly from the front wall 24 to the bottom of the rear wall 22 to define the water trough 20. The fan assembly 18 is positioned behind and below the diagonal wall 30. However, this is merely one illustrative example of placement. Other conventional or subsequently developed arrangements can be substituted. The fan assembly comprises a pair of centrifugal fans 32 each of which has an outlet cowl 34 which projects through the diagonal wall 30 and into the conduit 10 above the water trough 20 and below the coil assembly 16. The fans 32 may share a common drive axle turned by means of a drive pulley 38 connected through a belt 40 to a drive motor 42.

A recirculation line 44 may be arranged to extend through the side wall 26 of the conduit 10 near the bottom of the trough 20 to recirculate water back up to the water spray assembly 14.

The water spray assembly 14 comprises a water box 48 which extends along the side wall 26 and a pair of distribution pipes 50 which extend horizontally from the water box across the interior of the conduit 10 to its opposite wall 28. Each of the pipes 50 is fitted with a plurality of nozzles 52 which emit mutually intersecting fan shaped water sprays to provide an even distribution of water over the entire coil assembly 16.

The mist eliminator assembly 12 comprises a plurality of closely spaced elongated strips 54 which are bent along their length to form sinuous paths from the region of the water spray assembly out through the top of the conduit 10. It will be noted that the mist eliminator assembly extends across substantially the entire cross-section of the conduit, and, since the cross-section of the conduit 10 is substantially uniform, the mist eliminator assembly occupies substantially the same cross-sectional area of the conduit 10 as the coil assembly 16.

Figure 4:
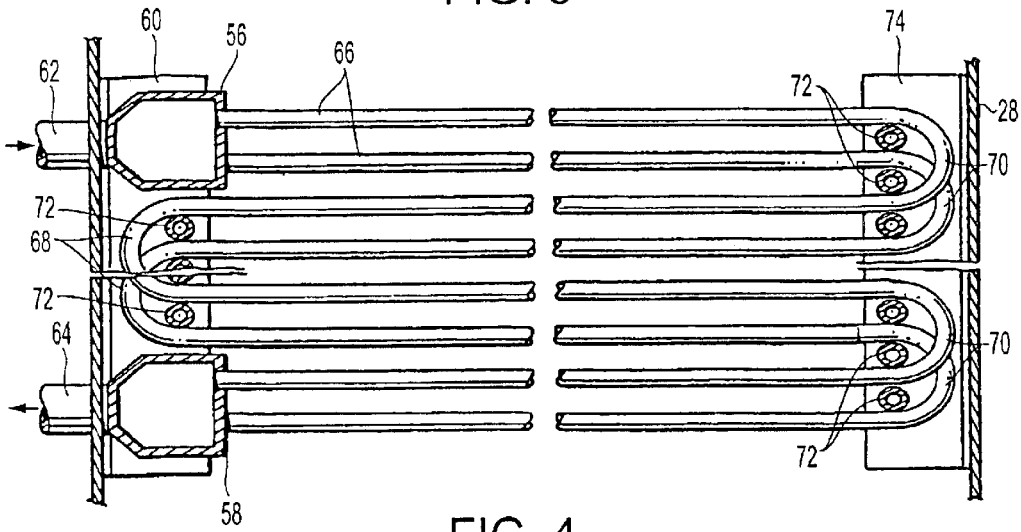
FIG. 4 is a view taken along line 4—4 of FIG. 3.

The coil assembly 16 according to either embodiment is better shown in FIGS. 3–4 and comprises an upper inlet manifold 56 and a lower outlet manifold 58 which extend horizontally across the interior of the conduit 10 adjacent the side wall 26. The manifolds are held in place by means of brackets 60 on the side wall 26. Inlet and outlet fluid conduits 62 and 64 extend through the side wall 26 and communicate with the upper and lower manifolds 56 and 58 respectively. These fluid conduits are connected to receive a fluid to be cooled or condensed, for example the refrigerant from a compressor in an air conditioning system (not shown).

A plurality of cooling tubes 66 are connected between the upper and lower manifolds 56 and 58. Each tube is preferably formed into a serpentine arrangement by means of 180 degree return bends 68 (and 70) near the side walls 26 and 28 so that different segments of each tube extend generally horizontally across the interior of the conduit 10 back and forth between the side walls 26 and 28 at different levels in the conduit along a vertical plane parallel and closely spaced to the plane of each of the other tubes 66. It will also be noted that the tubes 66 are arranged in alternately offset arrays. It can be seen that each of the manifolds 56 and 58 is provided with an upper and a lower row of openings to accept the tubes 66 at these two different levels. These tubes may have any suitable outside diameter D, such as ⅜"–2". However, in a preferred exemplary embodiment, they have a diameter of 1.0–1.25". The return 180 degree bends 68 may also have any suitable bend radius. However, an exemplary embodiment has a radius of 1.5–2.5". Further, the corresponding levels of the segments of adjacent tubes should be offset vertically from each other by an amount Approximately equal to the 180 degree bend radius.

In order to support the tubes 66 at the bends 68 (and 70) there are provided horizontally extending support rods 72 which are mounted at the wall 26, between the brackets 60 and, at the wall 28, between brackets 74.

The coil assembly 16 in cross-section comprises arrays of tube segments 66 arranged at different levels or elevations due to the offset arrangement of adjacent tubes. This assembly is similar to many prior coil assembly designs, but differs in the level of densification, as better illustrated by FIGS. 5–8 discussed below.

As explained in the standard handbook of the American Society of Heating, Refrigeration and Air Conditioning Engineers, two separate heat transfer processes are involved in the operation of evaporative heat exchangers. In the first heat transfer process, heat from the fluid being cooled or condensed passes through the tube walls to the water flowing over the tubes. In the second process, heat is transferred from the water flowing over the tubes to the upwardly flowing air. These two processes are described by the following equations:

$$q=A(t_c-t_s)U_s; \quad 1$$

and $$q=A(h_s-h_l)U_c, \quad 2$$

where q=total heat transferred; A=total tube surface area; $t_c$=fluid temperature in the tubes; $t_s$=water temperature outside the tubes; $U_s$=heat transfer coefficient—fluid to water; $h_s$ enthalpy of saturated air at $t_s$;$h_l$=enthalpy of ambient air; and $U_c$=heat transfer coefficient—water to air.

In both heat transfer processes, the amount of heat transferred is generally proportional to the total tube surface area provided there are no offsetting losses to the heat transfer coefficients and there is a corresponding increase in airflow. This can be especially advantageous in a coil/fill design which minimizes such offsetting effects.

Figure 5:
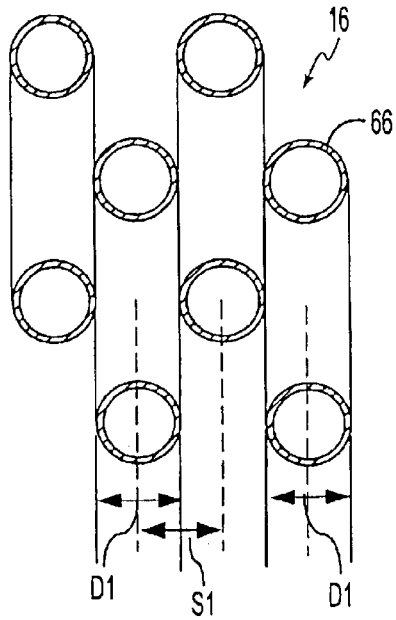
FIG. 5 PRIOR ART
FIG. 5 is a partial perspective view showing a tube segment array forming one portion of a coil assembly according to a first prior art heat exchanger.

FIG. 5 shows an exploded view of a coil assembly 16 cross-section of a prior art tube configuration in which round coil tubes 66 of a diameter D1 are provided in an overlapping configuration and closely abutted together in a tight packing. With this arrangement, a best circuit-to-circuit spacing of S1 could be achieved, which was equal to or slightly larger than D1. This results in a circuit density $D_1/S_1<1.0$.

Figure 6:
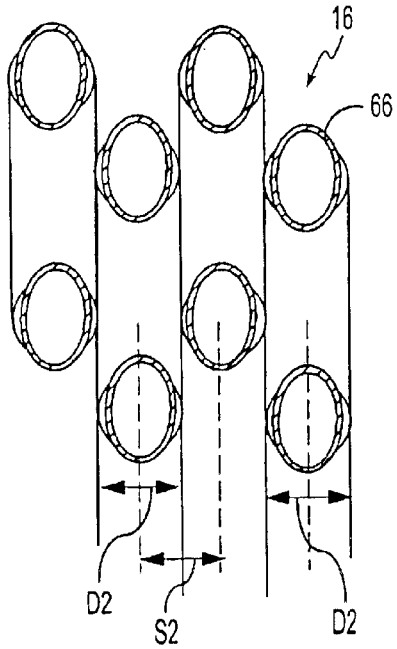
FIG. 6 PRIOR ART
FIG. 6 is a partial perspective view showing a tube segment array forming one portion of a coil assembly according to a second prior art heat exchanger.

FIG. 6 shows an exploded view of a coil assembly 16 cross-section of another prior art, exemplified by U.S. Pat. No. 5,425,414. In this arrangement, elliptical coil tubes 66 are provided in an overlapping configuration and closely abutted together in a tight packing as in FIG. 5. Although the longitudinal runs of the tubes are elliptical, the return bends are circular as shown with a diameter D2. Because of the elliptical tubing, additional air flow is provided between the elliptical tubes. However, because of the generally circular cross-section in the return bend area, the circuit-to-circuit spacing S2 remained equal to or slightly larger than D2 as in FIG. 5. Again, circuit density $D_2/S_2<1.0$.

Figure 7:
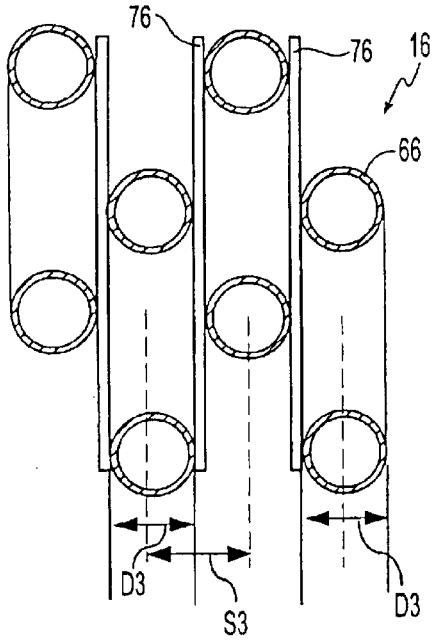
FIG. 7 PRIOR ART
FIG. 7 is a partial perspective view showing a tube segment array forming one portion of a coil assembly according to a third prior art heat exchanger.

FIG. 7 shows an exploded view of a coil assembly 16 cross-section of the prior art, as exemplified by U.S. Pat. No. 4,196,157. In this arrangement, round coil tubes 66 of a diameter D1 are provided in an overlapping configuration and separated by spacer bars 76. This resulted in a circuit-to-circuit spacing of S3, which was larger than D3. In particular, spacing S3 is equal to the diameter D3 of the tube segment 66 plus the thickness of spacer rod 76. This resulted in a sparsified tubing arrangement with lower density than FIGS. 5–6. That is, circuit density $D_3/S_3<<1.0$.

Prior to now, there was believed to be a limit to the achievable density of the tube bundle. With conventional stacking, the density ($D_x$:$S_x$) was ≦1.0 due to contact at the overlapping portions. Even with imprecise "pull down" methods, the density could only be increased to ≦1.02. However, by this inventive coil assembly and method, the individual tube circuits can be precisely packed with a density ($D_x$:$S_x$) higher than 1, preferably higher than 1.02, so increased surface area can be provided within a given heat exchanger area.

Figure 8:
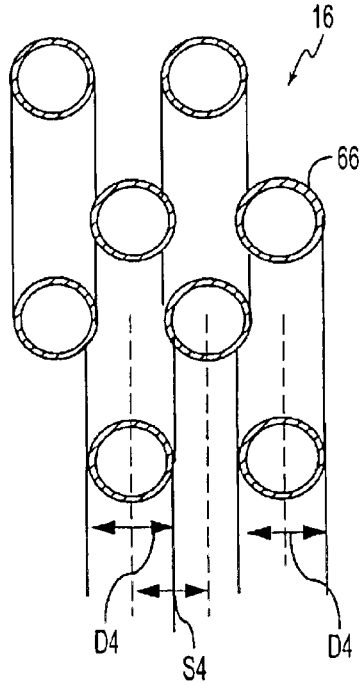
FIG. 8 is a partial perspective view showing a tube segment array forming one portion of a coil assembly according to an exemplary embodiment of the invention.

FIG. 8 shows an exploded view of a coil assembly 16 cross-section according to the invention in which coil tubes 66 are provided in an overlapping configuration and closely abutted together in a tighter, more densified packing. The tubes have a diameter of D4. However, by providing one or more depressions in the tubes at one or more regions of each overlap, the inventive coil assembly is capable of a circuit-to-circuit spacing S4 that is slightly less than D4, resulting in a coil density D/S>1.0, preferably greater than 1.02. Moreover, because the depressions can be formed at regions of overlap prior to assembly, the depressions can be made more precisely, so that a precise, preferably uniform, circuit to circuit spacing S4 can be provided throughout the assembly. This achieves a more consistent heat exchanger operation in which each circuit has substantially the same flow, pressure drop and other characteristic heat exchanger properties.

The depressions can include indentations, hollows, grooves, notches or dimples, for example, that reduce the outer dimensions of the tubing at regions of overlap. The depressions will have a predetermined depth based on several criteria, including the desired degree of compressionl/density, and the maximum reduction in tubular cross-sectional area as allowed by fluid, gas or two phase velocity and/or pressure drop. Exemplary depressions are formed by dimpling and have a depth of 5% to 50% of the tube diameter when provided on one side of the tubing. In a particular exemplary embodiment, dimpling is on the order of 1/16" to 3/16". However, when the dimpling is provided on both sides, the dimpling can have a reduced depth of 2.5% to 25%, since the complementary dimpling will have twice the effective increase in density increase as compared to single-sided dimpling.

In the FIG. 8 example, a circular cross-section is illustrated. Although this is a preferred configuration, in some instances it may be preferred to use tubes of non-circular cross section. The term "diameter" in such cases is to be understood as the diametrical distance across the tube cross-section in the stacking or overlapping direction. This may also sometimes be referred to as the projected cross-sectional area when the tube is not round.

In operation of the exemplary heat exchanger of FIGS. 2–4 and 8, a fluid to be cooled or condensed, such as a refrigerant from an air conditioning system, flows into the heat exchanger via the inlet conduit 62. This fluid is then distributed by the upper manifold 56 to the upper ends of the cooling tubes 66; and its flows down through the tubes, back and forth across the interior of the conduit 10 at different levels therein until it reaches the lower manifold 58 where it is collected and transferred out of the heat exchanger via the outlet conduit 64. As the fluid being cooled flows through the tubes 66, water is sprayed from the nozzles 52 down over the outer surfaces of the tubes and air is blown from the fans 32 up between the tubes. The sprayed water collects in the trough 20 and is recirculated through the nozzles. The upwardly flowing air passes through the mist eliminator assembly 12 and exhausts up out of the system.

During its downward flow through the cooling tubes 66, the fluid being cooled gives up heat to the walls of the tubes. This heat passes outwardly through the tube walls to water flowing down over their outer surface. As the downwardly flowing water encounters the upwardly moving air, the water gives up heat to the air, both by sensible heat transfer and by latent heat transfer, i.e. by partial evaporation. The remaining water falls back down into the trough 20 where it collects for recirculation. As the upwardly moving air encounters the downwardly flowing water and extracts heat from the water, the air also entrains a certain amount of water in the form of droplets which it carries up out from the coil assembly 16 and up out of the water spray assembly 14. However, as the air passes through the mist eliminator assembly 12, its flow is changed rapidly in lateral directions and the liquid droplets carried by the air become separated from the air and are deposited on the elements of the mist eliminator. This water then falls back onto the spray and coil assemblies. Meanwhile the resulting high humidity, but essentially droplet free, air is exhausted out through the top of the conduit 10 to the atmosphere.

In certain embodiments of the invention, the surface area of the coil assembly tubes 66 may be further increased by the use of closely spaced fins which extend outwardly, in a horizontal direction, from the surface of the tube segments.

In certain applications in which allowable pressure drop is a concern, quad-type bundles are typically used. Although the surface area and total length of tubing used is the same, quad bundles feed twice as many circuits of half the tube length as standard bundles. This reduces internal fluid pressure drops by a factor of approximately seven, but also reduces the overall heat transfer coefficient due to the lower tube velocity, even though comparable heat transfer surface area is provided. However, Quad tube bundles are typically more expensive than standard bundles, with about 5% to 15% less thermal performance. This is due in part to the additional amount of circuits that must be fabricated, handled and welded into the header manifold, along with a lower internal film coefficient due to the lower tube velocity. However, the inventive densified tube bundle allows the standard tube bundle design to extend its thermal operating range before the pressure drop limit is reached by allowing more internal flow area to be packed into the same space. As such, by use of the densified tube bundle assembly, the need for quad bundles may be reduced.

Figure 9:
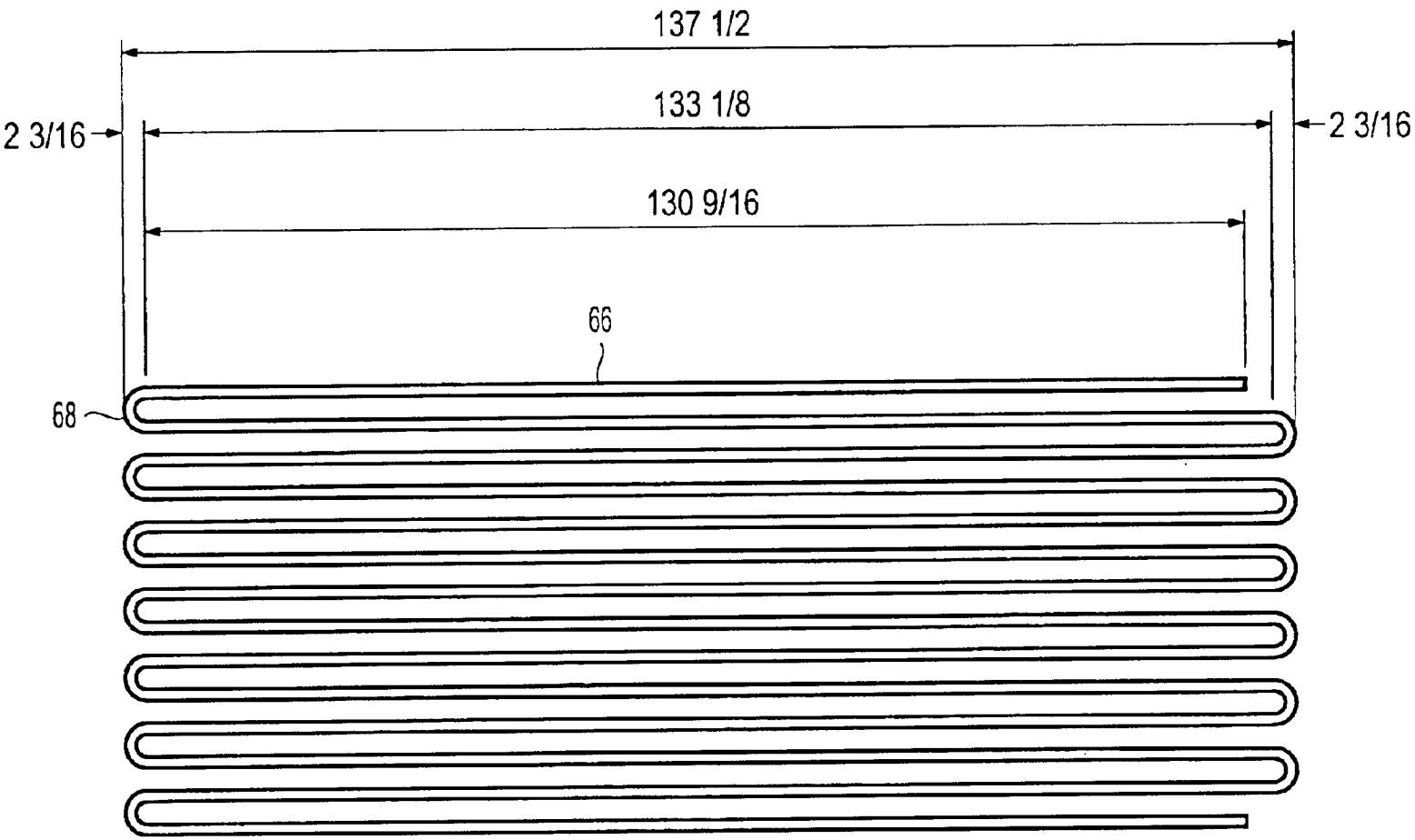
FIG. 9 is a front elevation view of an exemplary serpentine tube forming an individual circuit according to the invention.

An exemplary method of manufacture of the coil assembly will be described with reference to FIGS. 9—13. FIG. 9 shows an individual tube circuit formed by extruding and bending a continuous length of steel tubing 66 into the serpentine shape shown. Forty of these circuits will be combined to form a 40-circuit heat exchanger. Each tube 66 is formed from 1.05" diameter round tubing to have: an inside length L1 of 130 9/16" from the tube end to the return bend radius centerline; a length L2 of 133 1/8" from return bend radius centerline to return bend radius centerline; and a total length L3 of 137 1/2". However, the specific sizes are meant to be illustrative and not limiting.

Figure 10:
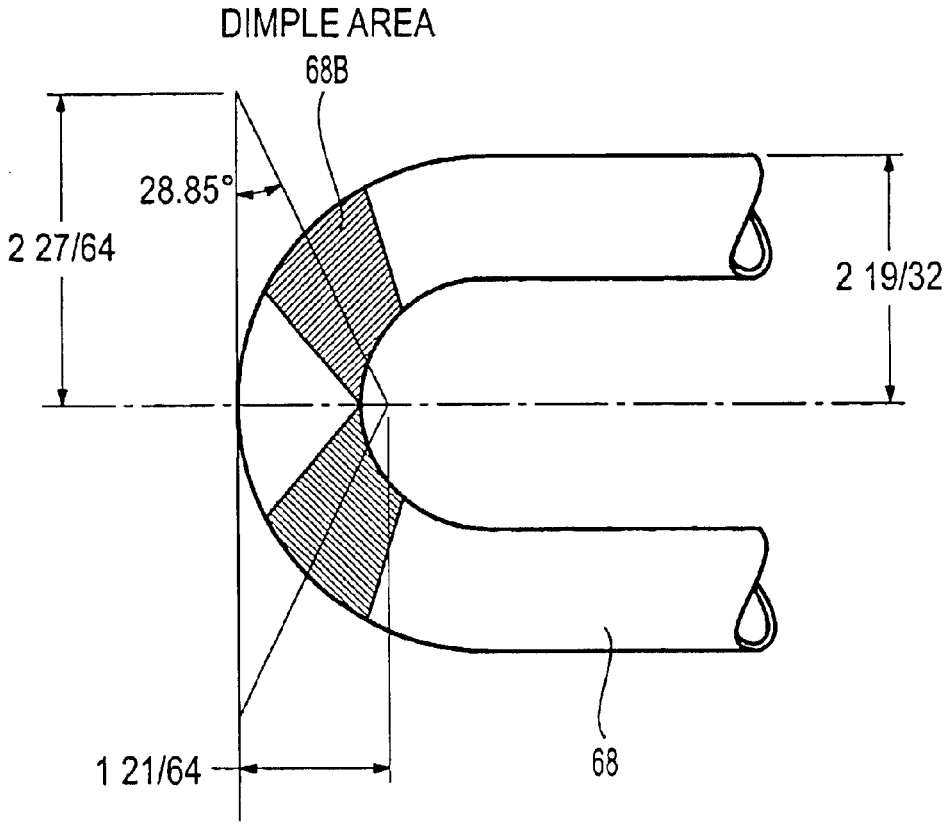
FIG. 10 is a partial front elevation view of each return bend of the tube of FIG. 9.

As shown in FIG. 10, each return bend 68 of tubing 66 has an outside radius of 2 19/32" (total width of 5 3/16"). At least one dimple area 68B is formed on the outermost end of the return bend. Each dimple area is sized and shaped to mate and nest with an adjacent overlapping return bend tube profile. In the example shown, two symmetrical dimpled areas are provided on both left and right sides of a top surface of each return bend. More particularly, in this specific example, an angle of approximately 30° was used, as measured from the end plane perpendicular to the longitudinal axis of the tube. This was calculated by triangulating the points where the angles cross the longitudinal and transverse axes. However, the angle will vary depending on the shape and overlap of the return bends.

Figure 11:
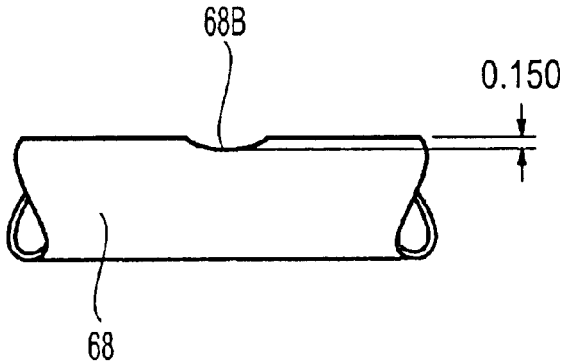
FIG. 11 is a partial plan view of the return bend of FIG. 10 in the dimple region.

Dimple areas 68B have a width sized to receive the adjacent overlapping return bend. The actual width depends on the depth of the dimple. Preferably, the dimple has a curvature that corresponds to the tube profile. In this case, the dimple is semi-spherical and has a depth of approximately 0.15" as shown in FIG. 11.

In exemplary embodiments of the invention, the dimples can be formed en mass by a die or jig that forms the dimples substantially simultaneously to all required areas on a circuit. Alternatively, individual dimples can be formed during the formation of the serpentine return bends. The particular method of production may be selected based on the particular method of tube manufacture used. In one exemplary embodiment, the dimples can be formed manually using a conventional dimpling tool either as each individual return bend 68 of the tubes 66 is formed, or manually performed after completion of individual circuits 66. In another embodiment, the process can also be automated by forming a jig, such as the dimpling jig 120 shown in FIG. 13. This jig allows formation of both dimple areas 68B at the same time. This process can be further automated by providing a plurality of such dimpling jigs, one for each return bend. If all such dimpling jigs are joined or indexed, dimpling can be achieved in a single operation or stroke for each individual circuit 66. This latter embodiment has the advantage of increasing productivity and ensuring accuracy of the dimpling.

Various different dimple configurations can be provided on the tubing. In the exemplary FIG. 10 embodiment, each return bend is dimpled in two places on one side (top or bottom) of the tubing so that regardless of the order of stacking of circuits, the tube bundles will always nest uniformly. However, dimpling may be provided on both sides of every return bend. In an alternative embodiment, dimpling is provided on both sides of every other return bend, leaving adjacent return bends undimpled but producing the same overall effect. In yet another exemplary embodiment, dimpling can be performed on both sides of all tubes, but with a reduced or less pronounced dimple size. This will have the same net result as larger dimples being provided on only one side. In yet another embodiment, the same effect can be achieved by use of a non-circular reduced cross-section in the process direction. An example of this would be an elliptical cross-section. However, a continuous reduction of cross-section in the return bend may have adverse affects on flow or heat transfer characteristics of the tubing. That is, dimpling has the advantage of adding only a minimal increase in internal fluid pressure drop as compared to compressing the entire return bend. Dimpling is also easier to form than compression of the entire return bend while having only a minimal, if any, effect on the structural characteristics of the tubing. Moreover, because the adjacent tubing nests in the dimple area, this serves to reinforce this area.

Figure 12:
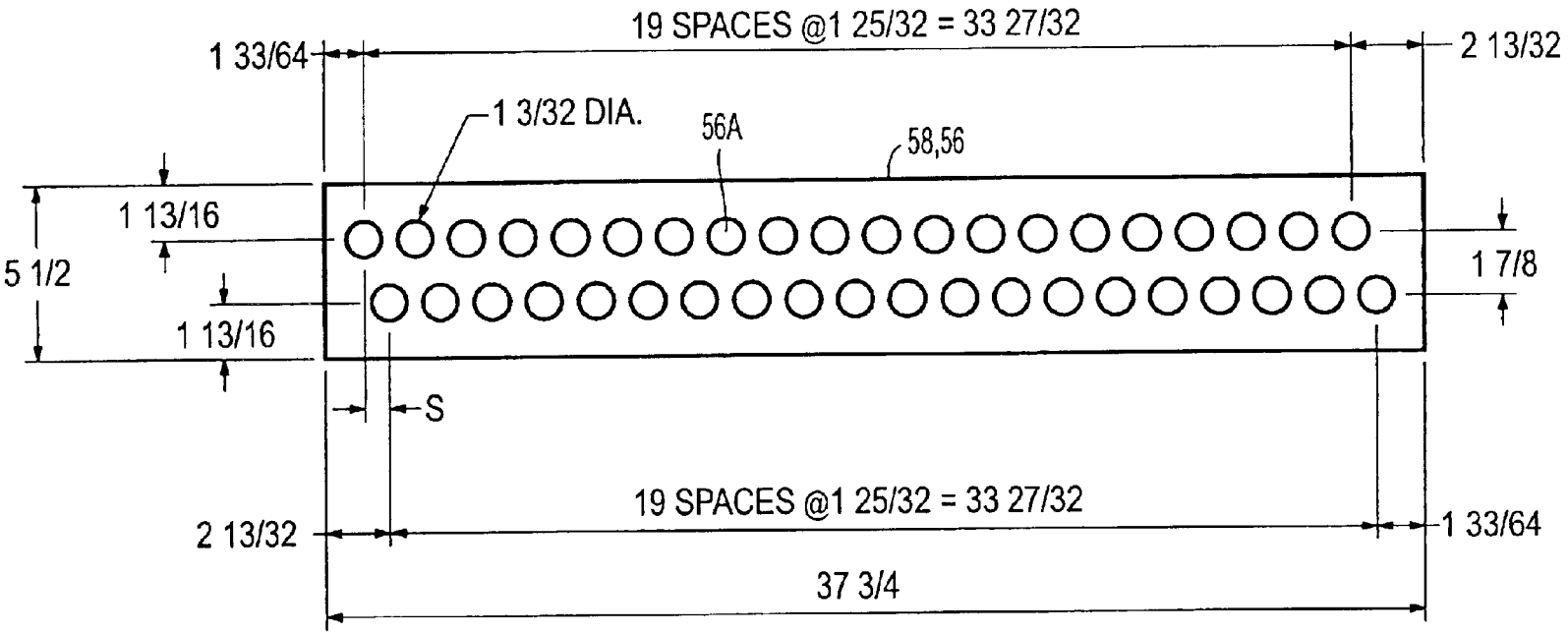
FIG. 12 is an end view of a header manifold receiving ends of the tube assembly according to an exemplary embodiment of the invention.
Figure 13:
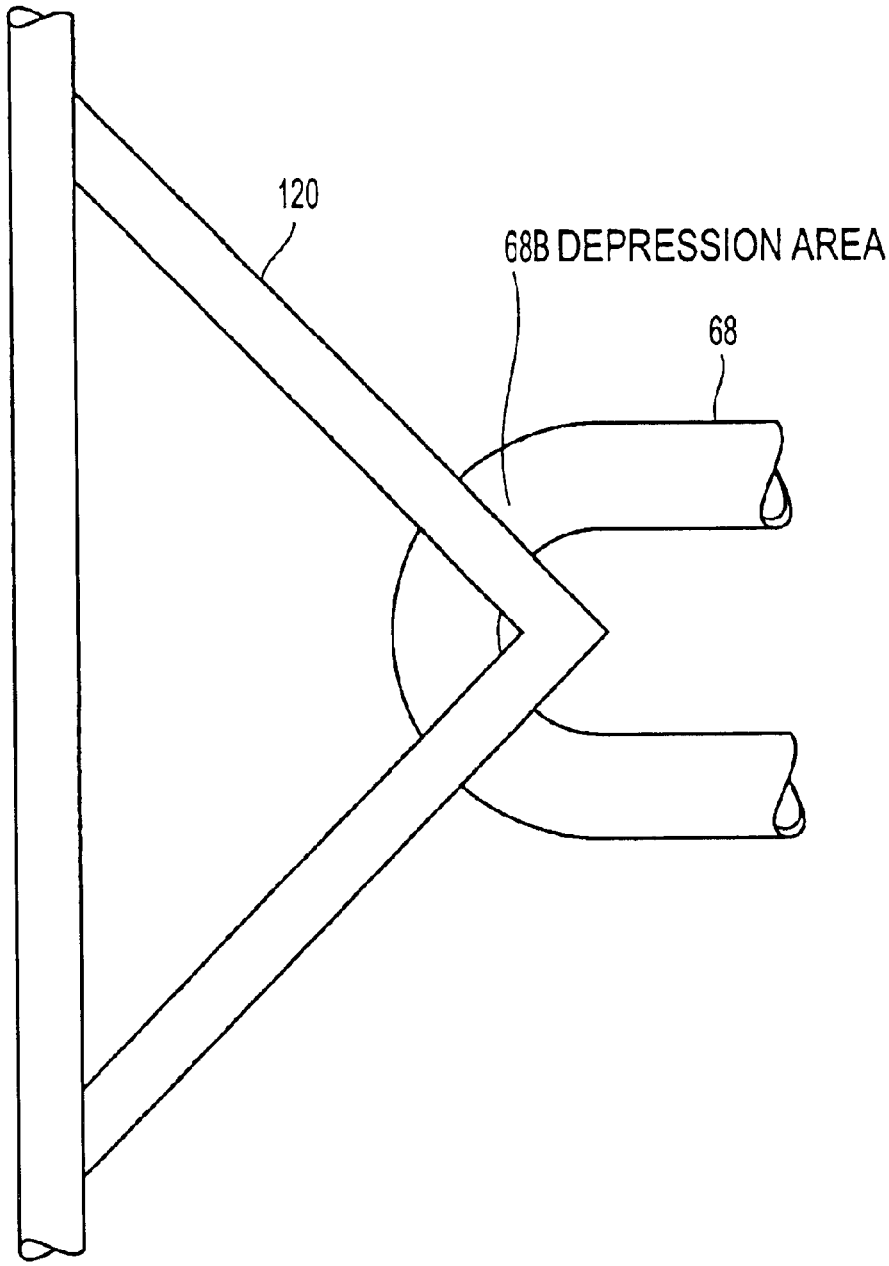
FIG. 13 is an exemplary V-shaped dimpler tool for forming a two-sided dimple region in the return bends.

FIG. 12 shows a manifold header 56 with 40 offset openings 56A sized to receive the ends of the forty individual tube circuits 66. In this example, the openings are each of a 1 3/32" diameter. As shown, the header has a total height H1 of 37¾". A first row of 20 openings are equispaced by 19 center-to-center spacings of 1 25/32" each, for a total center-to-center spacing H2 of 33 27/32". A second row of 20 openings are also equispaced by 19 spaces of 1 25/32" each, for a total center-to-center spacing H2 of 33 27/32". However, the second row is offset from the first. The first and second rows of openings are separated by distance W1 of 1⅞".

The resultant coil assembly 16 has an individual circuit-to-circuit spacing S that is less than the diameter of the tubing (i.e., S=57/64", D=1.05", packing density ratio=D/S=(1.05"÷57/64")=1.179). This allows the packing of additional circuits in a smaller heat exchanger housing since the exemplary 0.15" inch reduction in spacing S (from the previously thought maximum density of 1.02) multiplied by the number of circuits will eventually form a large enough difference to allow the addition of one or more additional circuits. Moreover, the resultant coil array can be made to be uniformly and/or precisely spaced at this density of >1.02 by the provision of precisely formed depression areas, such as dimples.

The inventive densified coil assembly may be beneficial in many different heat exchanger environments. The densified coil assembly allows increased heat transfer surface area to be packed into the same space/size constraints of prior designs or, conversely, allows the same heat transfer surface area as the prior art to be provided in a smaller enclosure. This has benefits where the size of the enclosure is fixed.

The densified coil assembly also reduces pressure drop in the heat exchanger by providing more circuits. This may be advantageous in many types of heat exchangers, such as the coil/fill type of FIG. 1, where pressure criteria may drive the design.

The inventive densified coil assembly also allows a more precise and controllable spacing between circuits. For example, by making all circuits uniformly spaced and dimpled, each circuit can have substantially the same air flow, pressure drop and other properties. This makes for an improved heat exchanger design.

Best results appear to be achieved when the inventive densified coil assembly is used in a coil/fill type heat exchanger, i.e., one that includes a combination direct and indirect evaporative heat exchange apparatus as in FIG. 1. This embodiment may achieve improved results compared to a coil only type heat exchangers, such as in FIG. 2, because the increase in tube density does not decrease overall unit air flow to the same degree that it may in a coil-only type heat exchanger.

An example of an application for a combination coil/fill heat exchanger with a densified coil is a closed loop cooling tower, in which an initially hot fluid, such as water, is generally directed upwardly through a series of circuits which comprise an indirect evaporative heat exchange section, where the hot water undergoes indirect sensible heat exchange with a counterflowing, cooler evaporative liquid gravitating over the outside surfaces of the circuits. In the preferred embodiment, the coldest water leaving each of the circuits is equally exposed to the coldest uniform temperature evaporative liquid and coldest uniform temperature ambient air streams available. This leads to a more uniform and necessarily more efficient method of heat transfer than accomplished by the prior art. As heat is transferred sensibly from the hot fluid, the evaporative liquid increases in temperature as it gravitates downwardly through the indirect evaporative heat exchange section. Simultaneously, cooler ambient air is drawn down over the circuits in a path that is concurrent with the gravitating evaporative liquid. Part of the heat absorbed by the evaporative liquid is transferred to the concurrently moving air stream, while the remainder of the absorbed heat results in an increase of temperature to the evaporative liquid as if flows downwardly over the circuits. The evaporative liquid then gravitates over a direct evaporative heat exchange section. The direct evaporative heat exchange section utilizes a separate source of cool ambient air to directly cool the now heated evaporative liquid through evaporative heat exchange. Air flow through the direct section is either crossflow or counterflow to the descending evaporative liquid. This now cooled evaporative liquid is then collected in a sump, resulting in a uniform temperature cooled evaporative liquid which is then redistributed to the top of the indirect evaporative section.

When applied as an evaporative condenser, the process is the same as explained for the closed circuit fluid cooling apparatus except that since the refrigerant condenses at an isothermal condition, the flow of the fluid, now a refrigerant gas, is typically reversed in order to facilitate drainage of the condensate.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed is:

1. A coil assembly for a heat exchanger, comprising:

an array of at least two serpentine circuits, each circuit including longitudinal tube sections of an effective diameter D, return bend sections of an effective diameter D, and inlet and outlet ends, the at least two serpentine circuits are stacked in a staggered planar arrangement with adjacent return bends being at least partially overlapping;

at least one of the at least two serpentine circuits being provided with at least one depression area coinciding with the point of overlap with the return bend of an adjacent one of the serpentine circuits, wherein the at least two serpentine circuits are densely packed so that adjacent ones of the serpentine tubes nest in the at least one depression area to provide a circuit-to-circuit packing density D/S greater than 1.02, where S is the spacing between each adjacent circuit and D is the effective diameter of the tubes.

2. The coil assembly according to claim 1, wherein the depression area has a depth of between 2.5–50% of the diameter D.

3. The coil assembly according to claim 1, wherein the depression area has a depth of between 1/32"–½".

4. The coil assembly according to claim 1, wherein the depression area has a profile that substantially matches the adjacent return bend at the point of overlap.

5. The coil assembly according to claim 4, wherein the profile is semi-cylindrical.

6. The coil assembly according to claim 1, wherein the depression area is provided on at least one of the top and bottom sides of at least alternating ones of the serpentine tubes.

7. The coil assembly according to claim 6, wherein the depression area is provided on both of the top and bottom sides of alternating ones of the serpentine tubes.

8. The coil assembly according to claim 6, wherein the depression area is provided on the top and bottom sides of all intermediate ones of the serpentine tubes in the array and each depression area has a depth of between 1.25% to 25% of the diameter D.

9. The coil assembly according to claim 6, wherein the depression area is provided on both left and right extremities of the top or bottom side to accommodate offset and overlap in either direction.

10. The coil assembly according to claim 1, wherein the depression area is achieved by forming at least the point of overlap of the return bends into a flattened cross-section shape.

11. The coil assembly according to claim 1, wherein the depression area is formed by a dimple.

12. The coil assembly according to claim 1, wherein the at least two serpentine circuits includes three or more circuits and the circuit-to-circuit spacing S is uniform between all of the serpentine circuits of the coil assembly.

13. A heat exchanger, comprising:

an array of at least two serpentine circuits, each circuit including longitudinal tube sections of an effective diameter D, return bend sections, and inlet and outlet ends, the at least two serpentine circuits are stacked in a staggered planar arrangement with adjacent return bends being at least partially overlapping;

at least one of the at least two serpentine circuits being provided with at least one depression area coinciding with the point of overlap with the return bend of an adjacent one of the serpentine circuits;

an inlet manifold connected to the inlets of each of the at least two serpentine tubes;

an outlet manifold connected to the outlets of each of the at least two serpentine tubes; and a conduit of a predetermined size housing the coil assembly and including a gas inlet and outlet, wherein the array of serpentine circuits are densely packed so that adjacent ones of the serpentine circuits nest in the at least one depression area to provide a circuit-to-circuit packing density D/S greater than 1.02, where S is the spacing between each adjacent circuit and D is the effective diameter of the tubes.

14. The heat exchanger according to claim 13, further comprising a fan arranged to move a gas from the conduit gas inlet, through the coil assembly and out the conduit gas outlet.

15. The heat exchanger according to claim 14, further comprising a liquid distribution system arranged above the coil assembly to distribute liquid down over the coil assembly.

16. The heat exchanger according to claim 13, wherein the heat exchanger is an evaporative heat exchanger.

17. The heat exchanger according to claim 16, wherein the evaporative heat exchanger is an indirect heat exchanger.

18. The heat exchanger according to claim 16, wherein the evaporative heat exchanger includes both a direct evaporative heat exchanger system and an indirect evaporative heat exchanger system.

19. The heat exchanger according to claim 18, wherein the heat exchanger is of the coil/fill type.

20. A coil assembly for a heat exchanger, comprising:

an array of at least two serpentine circuits, each circuit including longitudinal tube sections of an effective diameter D, return bend sections, and inlet and outlet ends, the array of at least two serpentine circuits is stacked in a staggered planar arrangement with adjacent return bends being at least partially overlapping; and a depression area coinciding with each point of overlap of the return bends of adjacent serpentine circuits being provided on a surface of at least one of the overlapping return bends, each depression area defining a region of reduced diameter, an inlet manifold connected to the inlets of each of the at least two serpentine circuits;

an outlet manifold connected to the outlets of each of the at least two serpentine tubes; and wherein the array of at least two serpentine circuits are densely packed with adjacent ones of the serpentine circuits nesting in the depression area and defining a uniform circuit-to-circuit spacing S between each adjacent circuit that is less than the effective diameter D of the tubes.

21. The coil assembly according to claim 20, wherein the region of reduced diameter has a depth of between 2.5–50% of tube diameter D.

22. The coil assembly according to claim 21, wherein the region of reduced diameter is provided only around the point of overlap in the return bends to minimize internal fluid pressure drop.

23. A heat exchanger, comprising:

the coil assembly of claim 20;

a conduit of a predetermined size housing the coil assembly and including a gas inlet and outlet.

* * * * *